US011238800B2

(12) United States Patent
He et al.

(10) Patent No.: US 11,238,800 B2
(45) Date of Patent: Feb. 1, 2022

(54) SET-VOLTAGE GENERATION UNIT, SET-VOLTAGE GENERATION METHOD AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Min He, Beijing (CN); Wenchao Bao, Beijing (CN); Chun Cao, Beijing (CN); Wei Chen, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/957,043

(22) PCT Filed: Jan. 22, 2020

(86) PCT No.: PCT/CN2020/073754
§ 371 (c)(1),
(2) Date: Jun. 22, 2020

(87) PCT Pub. No.: WO2020/151740
PCT Pub. Date: Jul. 30, 2020

(65) Prior Publication Data

US 2021/0241692 A1 Aug. 5, 2021

(30) Foreign Application Priority Data

Jan. 25, 2019 (CN) ..... 201910073659.2

(51) Int. Cl.
*G09G 3/3258* (2016.01)

(52) U.S. Cl.
CPC ..... *G09G 3/3258* (2013.01); *G09G 2310/027* (2013.01); *G09G 2330/028* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,135,853 | B2 | 9/2015 | Kim et al. | |
| 9,324,274 | B2 | 4/2016 | Kim | |
| 2003/0058235 | A1 | 3/2003 | Moon | |
| 2006/0125761 | A1* | 6/2006 | Ahn | G09G 3/3696 345/98 |

(Continued)

FOREIGN PATENT DOCUMENTS

| | | | |
|---|---|---|---|
| CN | 1414539 | A | 4/2003 |
| CN | 1987989 | A | 6/2007 |

(Continued)

OTHER PUBLICATIONS

State Intellectual Property Office of the People's Republic of China, Office Action and Search Report Issued in Application No. 201910073659.2, dated Mar. 19, 2020, 22 pages. (Submitted with Partial Translation).

(Continued)

*Primary Examiner* — Van N Chow
(74) *Attorney, Agent, or Firm* — McCoy Russell LLP

(57) ABSTRACT

The present disclosure provides a set-voltage generation unit, a set-voltage generation method and a display device. The set-voltage generation unit includes a voltage generation circuit. The set-voltage generation unit is configured to generate a set voltage according to a gamma main voltage such that a ratio between a variation of the set voltage and a variation of the gamma main voltage is a voltage coefficient K, and K is a positive number less than or equal to 1.

18 Claims, 4 Drawing Sheets

(56) References Cited

U.S. PATENT DOCUMENTS

| | | | | |
|---|---|---|---|---|
| 2007/0085792 | A1* | 4/2007 | Tseng | G09G 3/3275 345/89 |
| 2007/0146355 | A1 | 6/2007 | Bae | |
| 2008/0100646 | A1 | 5/2008 | Suzuki | |
| 2010/0013869 | A1* | 1/2010 | Matsumoto | G09G 3/3666 345/690 |
| 2010/0253664 | A1 | 10/2010 | Byun et al. | |
| 2012/0062609 | A1* | 3/2012 | Jeon | G09G 3/3208 345/690 |
| 2015/0179103 | A1 | 6/2015 | Tani et al. | |
| 2016/0012763 | A1 | 1/2016 | Chen et al. | |
| 2016/0078806 | A1 | 3/2016 | Lim et al. | |
| 2016/0247451 | A1 | 8/2016 | Kim et al. | |
| 2017/0330521 | A1* | 11/2017 | Zhao | G02F 1/13454 |
| 2018/0190194 | A1 | 7/2018 | Zhu et al. | |
| 2018/0197446 | A1 | 7/2018 | Lee et al. | |

FOREIGN PATENT DOCUMENTS

| | | | | | |
|---|---|---|---|---|---|
| CN | 101814267 | A | | 8/2010 | |
| CN | 103065594 | A | | 4/2013 | |
| CN | 103794187 | A | | 5/2014 | |
| CN | 104637435 | A | | 5/2015 | |
| CN | 104732906 | A | | 6/2015 | |
| CN | 105448239 | A | | 3/2016 | |
| CN | 105931598 | A | | 9/2016 | |
| CN | 106098000 | A | | 11/2016 | |
| CN | 107358915 | A | | 11/2017 | |
| CN | 107591137 | A | | 1/2018 | |
| CN | 108288458 | A | | 7/2018 | |
| CN | 108847184 | A | | 11/2018 | |
| CN | 109830210 | A | | 5/2019 | |
| JP | 2008107516 | A | | 5/2008 | |
| KR | 20160020597 | A | * | 2/2016 | G09G 3/3208 |

OTHER PUBLICATIONS

ISA China National Intellectual Property Administration, International Search Report Issued in Application No. PCT/CN2020/073754, dated Apr. 21, 2020, WIPO, 17 pages. (Submitted with Partial Translation).

* cited by examiner

SET-VOLTAGE GENERATION UNIT, SET-VOLTAGE GENERATION METHOD AND DISPLAY DEVICE

CROSS-REFERENCE TO RELATED APPLICATIONS

The present application is a U.S. national phase application of PCT Application No. PCT/CN2020/073754 filed on Jan. 22, 2020, which claims the benefit and priority of Chinese Application No. 201910073659.2, filed on Jan. 25, 2019. The entire contents of each of the above-listed applications are hereby incorporated by reference for all purposes.

TECHNICAL FIELD

The present disclosure relates to the field of display technologies, and in particular to a set-voltage generation unit, a set-voltage generation method and a display device.

BACKGROUND AND SUMMARY

During the operation of an OLED display device, it is affected by external factors (mainly referring to temperature) and instability of its own circuit, resulting in poor display performance.

The present disclosure provides a display device including: M rows and N columns of pixel circuits and N set-voltage generation units. The set-voltage generation unit includes a voltage generation circuit; the set-voltage generation unit is configured to generate a set voltage according to a gamma main voltage such that a ratio between a variation of the set voltage and a variation of the gamma main voltage is a voltage coefficient K, and K is a positive number less than or equal to 1. An output terminal of an n-th set-voltage generation unit is coupled with pixel circuits in the n-th column, and is configured to provide the set voltage for the pixel circuits in the n-th column. Both M and N are integers greater than 1, n is a positive integer less than or equal to N.

In implementation, the display device further includes a display substrate; the pixel circuits are disposed at a display area of the display substrate; and the set-voltage generation units are disposed at a peripheral area of the display substrate.

In implementation, the display device further includes a display substrate and a drive integrated circuit. The pixel circuits are disposed at a display area of the display substrate; and the set-voltage generation units are disposed in the drive integrated circuit.

In implementation, the display device further includes: N columns of detection lines, M rows of gate lines, N columns of data lines, M rows of compensation control lines and M rows of write control lines. The gate line is configured to output a gate drive signal, the data line is configured to output a real-time data voltage, the compensation control line is configured to input a compensation control signal, and the write control line is configured to input a write control signal.

A pixel circuit in an m-th row and an n-th column includes a light emitting element in the m-th row and the n-th column, a drive circuit in the m-th row and the n-th column, a display control circuit in the m-th row and the n-th column, a compensation control circuit in the m-th row and the n-th column, and a set-voltage write control circuit in the m-th row and the n-th column.

A drive circuit in the m-th row and the n-th column is configured to, under control of a control terminal thereof, drive the light emitting element in the m-th row and the n-th column.

A display control circuit in the m-th row and the nth column is coupled with the control terminal of the drive circuit in the m-th row and the n-th column; and is configured to, under control of a gate drive signal output by a gate line in the m-th row, perform display driving control on the drive circuit in the m-th row and the n-th column according to a real-time data voltage of a data line in the n-th column.

A compensation control circuit in the m-th row and the n-th column is configured to, under control of a compensation control signal input by a compensation control line in the m-th row, control a first terminal of the drive circuit in the m-th row and the n-th column to be coupled with a detection line in the n-th column.

A set-voltage write control circuit in the m-th row and the n-th column is configured to, under control of a write control signal input by a write control line in the m-th row, control a set-voltage write terminal in the m-th row and the n-th column to be coupled with the detection line in the n-th column.

An n-th set-voltage generation unit is configured to write a set voltage in the m-th row and the n-th column to the set-voltage write terminal in the m-th row and the n-th column, to control writing the set voltage in the m-th row and the n-th column to the detection line in the n-th column when the set-voltage write control circuit in the m-th row and the n-th column controls the set-voltage write terminal in the m-th row and the n-th column to be coupled with the detection line in the n-th column, m is a positive integer less than or equal to M.

In implementation, the compensation control circuit in the m-th row and the n-th column includes a compensation control transistor in the m-th row and the n-th column; and the set-voltage write control circuit in the m-th row and the n-th column includes a write control switch in the m-th row and the n-th column; a control electrode of the compensation control transistor in the m-th row and the n-th column is coupled with the compensation control line in the m-th row; a first electrode of the compensation control transistor in the m-th row and the n-th column is coupled with the first terminal of the drive circuit in the m-th row and the n-th column; a second electrode of the compensation control transistor in the m-th row and the n-th column is coupled with the detection line in the n-th column; a control terminal of the write control switch in the m-th row and the n-th column is coupled with the write control line in the m-th row; a first terminal of the write control switch in the m-th row and the n-th column is coupled with the set-voltage write terminal in the m-th row and the n-th column; a second terminal of the write control switch in the m-th row and the n-th column is coupled with the detection line in the n-th column.

In implementation, the drive circuit in the m-th row and the n-th column includes a drive transistor in the m-th row and the n-th column; and the display control circuit in the m-th row and the n-th column includes a data write transistor in the m-th row and the n-th column, and a storage capacitor in the m-th row and the n-th column.

A gate electrode of the drive transistor in the m-th row and the n-th column is the control terminal of the drive circuit in the m-th row and the n-th column.

A control electrode of the data write transistor in the m-th row and the n-th column is coupled with the gate line in the m-th row; a first electrode of the data write transistor in the m-th row and the n-th column is coupled with the data line in the n-th column; a second electrode of the data write transistor in the m-th row and the n-th column is coupled with the gate electrode of the drive transistor in the m-th row and the n-th column.

A first electrode of the drive transistor in the m-th row and the n-th column is coupled with the light emitting element in the m-th row and the n-th column; a second electrode of the drive transistor in the m-th row and the n-th column is coupled with the power supply voltage terminal.

A first terminal of the storage capacitor in the m-th row and the n-th column is coupled with the gate electrode of the drive transistor in the m-th row and the n-th column; a second terminal of the storage capacitor in the m-th row and the n-th column is coupled with the first electrode of the drive transistor in the m-th row and the n-th column.

In implementation, the set-voltage generation unit further includes an adjustment circuit; the adjustment circuit is configured to adjust the voltage coefficient K to be (a+1)/B according to the real-time data voltage, wherein "a" represents a gray scale corresponding to a real-time data voltage, "B" represents a total number of gray scales, "a" is 0 or a positive integer less than "B", and "B" is a positive integer.

In implementation, the voltage generation circuit includes an operational amplifier circuit and a voltage division circuit; the voltage division circuit is configured to divide the gamma main voltage to obtain a divided voltage, and input the divided voltage to a positive input terminal of the operational amplifier circuit; an inverting input terminal of the operational amplifier circuit is coupled with a reference voltage terminal; the operational amplifier circuit is configured to generate the set voltage according to the divided voltage and a reference voltage input by the reference voltage terminal.

In implementation, the set-voltage generation unit further includes an adjustment circuit; the adjustment circuit is configured to provide a voltage division adjustment signal to the voltage division circuit according to the real-time data voltage, so that the voltage division circuit controls a ratio between a variation of the divided voltage and the variation of the gamma main voltage to be equal to "b", and then the voltage coefficient K is adjusted accordingly to be (a+1)/M, wherein "a" represents a gray scale corresponding to the real-time data voltage, "M" represents a total number of gray scales, "a" is 0 or a positive integer less than "M", "M" is a positive integer; "b" represents a voltage division coefficient and is equal to K/A, and A is an amplification factor of the operational amplifier circuit.

In implementation, the voltage division circuit includes a first voltage division resistor and a second voltage division resistor; a first end of the first voltage division resistor receives the gamma main voltage; a second end of the first voltage division resistor is coupled with the positive input terminal of the operational amplifier circuit; a first end of the second voltage division resistor is coupled with the positive input terminal; a second end of the second voltage division resistor is coupled with a first voltage terminal; resistance values of the first voltage division resistor and the second voltage division resistor are adjustable.

In implementation, the voltage division adjustment signal includes a resistance value adjustment signal; the adjustment circuit is configured to transmit the resistance value adjustment signal to the first voltage division resistor and/or the second voltage division resistor according to the real-time data voltage and the gamma main voltage, to control adjustment of a resistance value Rz1 of the first voltage division resistor and/or a resistance value Rz2 of the second voltage division resistor, thereby adjusting the voltage coefficient K; Rz2/(Rz1+Rz2) is equal to "b".

The present disclosure provides a set-voltage generation unit including a voltage generation circuit. An output terminal of the set-voltage generation unit is coupled with a pixel circuit; the set-voltage generation unit is configured to generate a set voltage according to a gamma main voltage such that a ratio between a variation of the set voltage and a variation of the gamma main voltage is a voltage coefficient K, and K is a positive number less than or equal to 1.

In implementation, the set-voltage generation unit further includes an adjustment circuit. The adjustment circuit is configured to adjust the voltage coefficient K to be (a+1)/B according to a real-time data voltage, wherein "a" represents a gray scale corresponding to the real-time data voltage, "B" represents a total number of gray scales, "a" is 0 or a positive integer less than "B", and "B" is a positive integer.

In implementation, the voltage generation circuit includes an operational amplifier circuit and a voltage division circuit; the voltage division circuit is configured to divide the gamma main voltage to obtain a divided voltage, and input the divided voltage to a positive input terminal of the operational amplifier circuit; an inverting input terminal of the operational amplifier circuit is coupled with a reference voltage terminal; the operational amplifier circuit is configured to generate the set voltage according to the divided voltage and a reference voltage input by the reference voltage terminal.

In implementation, the set-voltage generation unit further includes an adjustment circuit; the adjustment circuit is configured to provide a voltage division adjustment signal to the voltage division circuit according to a real-time data voltage, so that the voltage division circuit controls a ratio between a variation of the divided voltage and the variation of the gamma main voltage to be equal to "b", and then the voltage coefficient K is adjusted accordingly to be (a+1)/M, wherein "a" represents a gray scale corresponding to the real-time data voltage, "M" represents a total number of gray scales, "a" is 0 or a positive integer less than "M", "M" is a positive integer; "b" represents a voltage division coefficient and is equal to K/A, and A is an amplification factor of the operational amplifier circuit.

In implementation, the voltage division circuit includes a first voltage division resistor and a second voltage division resistor; a first end of the first voltage division resistor receives the gamma main voltage; a second end of the first voltage division resistor is coupled with the positive input terminal of the operational amplifier circuit; a first end of the second voltage division resistor is coupled with the positive input terminal; a second end of the second voltage division resistor is coupled with a first voltage terminal; resistance values of the first voltage division resistor and the second voltage division resistor are adjustable.

In implementation, the voltage division adjustment signal includes a resistance value adjustment signal; the adjustment circuit is configured to transmit the resistance value adjustment signal to the first voltage division resistor and/or the second voltage division resistor according to the real-time data voltage and the gamma main voltage, to control adjustment of a resistance value Rz1 of the first voltage division resistor and/or a resistance value Rz2 of the second voltage division resistor, thereby adjusting the voltage coefficient K; Rz2/(Rz1+Rz2) is equal to "b".

The present disclosure provides a set-voltage generation method applied to the above set-voltage generation unit, including: generating, by the voltage generation circuit, a set voltage according to a gamma main voltage so that a ratio between a variation of the set voltage and a variation of the gamma main voltage is a voltage coefficient K, wherein K is a positive number less than or equal to 1.

In implementation, the set-voltage generation unit further includes an adjustment circuit; the set-voltage generation method includes: adjusting, by the adjustment circuit, the voltage coefficient K to be (a+1)/B according to a real-time data voltage; wherein "a" represents a gray scale corresponding to the real-time data voltage, "B" represents a total number of gray scales, "a" is 0 or a positive integer less than "B".

In implementation, the voltage generation circuit includes an operational amplifier circuit and a voltage division circuit; the step of generating, by the voltage generation circuit, a set voltage according to a gamma main voltage, includes: dividing, by the voltage division circuit, the gamma main voltage to obtain a divided voltage, and inputting the divided voltage to a positive input terminal of the operational amplifier circuit; generating, by the operational amplifier circuit, the set voltage according to the divided voltage and a reference voltage input by a reference voltage terminal.

In implementation, the voltage generation circuit further includes an adjustment circuit; the set-voltage generation method further includes: providing, by the adjustment circuit, a voltage division adjustment signal to the voltage division circuit according to a real-time data voltage, so that the voltage division circuit controls a ratio between a variation of the divided voltage and the variation of the gamma main voltage to be equal to "b", and then the voltage coefficient K is adjusted accordingly to be (a+1)/B; wherein "a" represents a gray scale corresponding to the real-time data voltage, "B" represents a total number of gray scales, "a" is 0 or a positive integer less than "B", and "B" is a positive integer; "b" represents a voltage division coefficient and is equal to K/A, and A is an amplification factor of the operational amplifier circuit.

In implementation, the voltage division circuit includes a first voltage division resistor and a second voltage division resistor; the voltage division adjustment signal includes a resistance value adjustment signal.

The step of providing, by the adjustment circuit, a voltage division adjustment signal to the voltage division circuit according to a real-time data voltage, so that the voltage division circuit controls a ratio between a variation of the divided voltage and the variation of the gamma main voltage to be equal to "b", and then the voltage coefficient K is adjusted accordingly to be (a+1)/B, includes: transmitting, by the adjustment circuit, the resistance value adjustment signal to the first voltage division resistor and/or the second voltage division resistor according to the real-time data voltage, to control adjustment of the resistance value Rz1 of the first voltage division resistor and/or the resistance value Rz2 of the second voltage division resistor, thereby adjusting the voltage coefficient K, wherein Rz2/(Rz1+Rz2) is equal to "b".

DETAILED DESCRIPTION

The technical solutions in the embodiments of the present disclosure will be described hereinafter in a clear and complete manner in conjunction with the drawings of the embodiments. Obviously, the following embodiments are merely a part of, rather than all of, the embodiments of the present disclosure, and based on these embodiments, a person skilled in the art may obtain the other embodiments, which also fall within the scope of the present disclosure.

During the operation of an OLED display device, due to the influence of external factors (mainly referring to temperature) and instability of its own circuit, a gamma main voltage AVDD may generate a variation V0, which affects stability of a gamma voltage and results in a variation V01 of a real-time data voltage Vdata output by a data drive circuit. In a pixel circuit with compensation function in the related art, a set voltage $V_{PRESL}$ is a stable voltage value; during compensation detection, a gate-source voltage of a drive transistor in the pixel circuit is Vdata+V1−$V_{PRESL}$, which causes compensation errors and then results in poor compensation display performance.

Transistors used in all embodiments of the present disclosure may each be a triode, a thin film transistor, a field effect transistor or other device having same characteristics. In the embodiments of the present disclosure, in order to distinguish two electrodes of the transistor in addition to a control electrode, one of the two electrodes is referred to as a first electrode, and the other electrode is referred to as a second electrode.

In actual operation, when the transistor is a triode, the control electrode may be a base, the first electrode may be a collector, and the second electrode may be an emitter; or the control electrode may be a base, the first electrode may be an emitter and the second electrode may be a collector.

In actual operation, when the transistor is a thin film transistor or a field effect transistor, the control electrode may be a gate electrode, the first electrode may be a drain electrode, and the second electrode may be a source electrode; or the control electrode may be a gate electrode, the first electrode may be a source electrode, and the second electrode may be a drain electrode.

Figure 1A:
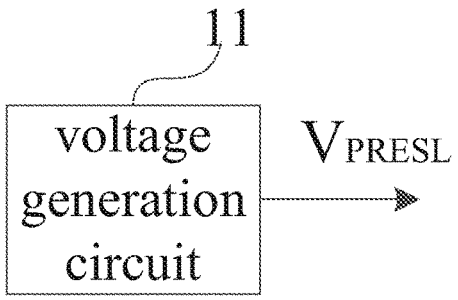
FIG. 1A is a schematic diagram of a set-voltage generation unit according to an embodiment of the present disclosure.

As shown in FIG. 1A, a set-voltage generation unit according to an embodiment of the present disclosure includes a voltage generation circuit 11.

The voltage generation circuit 11 is configured to generate a set voltage $V_{PRESL}$ according to a gamma main voltage AVDD such that a ratio between a variation V01 of the set voltage $V_{PRESL}$ and a variation V0 of the gamma main voltage AVDD is a voltage coefficient K, where K is a positive number less than or equal to 1.

The set-voltage generation unit according to one embodiment of the present disclosure includes the voltage generation circuit 11 that generates the set voltage $V_{PRESL}$ according to the gamma main voltage AVDD such that the variation of the set voltage $V_{PRESL}$ is direct proportion to the variation (i.e., fluctuation value) of the gamma main voltage AVDD, that is, the ratio between the variation V01 of the set voltage $V_{PRESL}$ and the variation V0 of the gamma main voltage AVDD is the voltage coefficient K. In this way, the variation of the set voltage $V_{PRESL}$ is equal to a variation of a real-time data voltage Vdata caused by jitter of the gamma main voltage AVDD, which can eliminate the compensation error caused by fluctuation of the gamma main voltage AVDD and ensure a good compensation display performance.

Figure 1B:
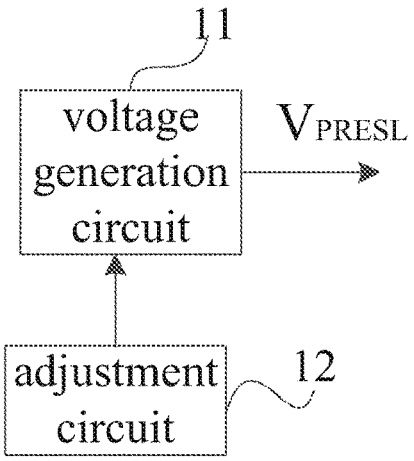
FIG. 1B is a schematic diagram of a set-voltage generation unit according to another embodiment of the present disclosure.

As shown in FIG. 1B, on the basis of the embodiment of the set-voltage generation unit shown n FIG. 1A, the set-voltage generation unit further includes an adjustment circuit 12.

The adjustment circuit 12 is coupled with the voltage generation circuit 11, and is configured to adjust the voltage coefficient K to be (a+1)/B according to a real-time data voltage, where "a" represents a gray scale corresponding to the real-time data voltage, "B" represents a total number of gray scales, "a" is 0 or a positive integer less than "B", and "B" is a positive integer.

In one embodiment of the present disclosure, the adjustment circuit 12 adjusts the voltage coefficient K to be (a+1)/B according to the real-time data voltage Vdata.

In specific implementation, assuming that the total number of gray scales is 256, that is, "B" is equal to 256, a data drive circuit outputs a total of 256 gray scale voltages, and the gray scale corresponding to the real-time data voltage Vdata is a (a is 0 or a positive integer less than 256), then, K is equal to (a+1)/256.

In specific implementation, the real-time data voltage is obtained according to the gamma main voltage AVDD, and the variation of the real-time data voltage is proportional to the variation of the gamma main voltage AVDD. That is, the ratio between the variation V01 of the set voltage $V_{PRESL}$ and the variation V0 of the gamma main voltage AVDD is the voltage coefficient K.

In actual operation, the real-time data voltage can be obtained according to the gamma main voltage AVDD. For example, when AVDD is 8V, a common electrode voltage is 0V and a data drive circuit outputs 256 gray scale voltages (the gray scale voltage is also referred to as a data voltage), the real-time data voltage corresponding to the gray scale 0 is 0V, and the corresponding voltage coefficient K is equal to 0; the real-time data voltage corresponding to the gray scale 255 is 8V, and the corresponding voltage coefficient K is equal to 1; the data voltage corresponding to the gray scale 127 is 4V, and the corresponding voltage coefficient K is equal to 1/2; the data voltage corresponding to the gray scale a is (8×(a+1)/256)V, and the corresponding voltage coefficient K is equal to (a+1)/256. As can be seen from the above, the variation of the data voltage is proportional to the variation of the gamma main voltage AVDD. Where "a" is 0 or a positive integer less than 256.

Figure 2A:
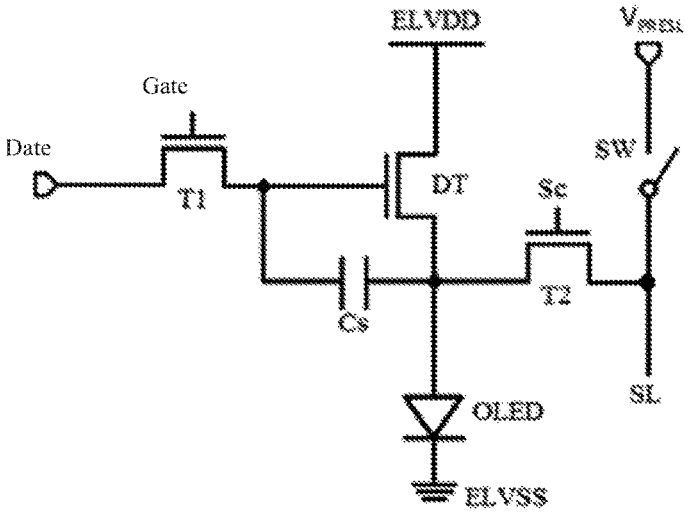
FIG. 2A is a circuit diagram of a pixel circuit with compensation function according to an embodiment of the present disclosure.

In specific implementation, as shown in FIG. 2A, one specific embodiment of a pixel circuit with compensation function includes a drive transistor DT, a data write transistor T1, a storage capacitor CS, a compensation control transistor T2, a write control switch SW, and an organic light-emitting diode (OLED).

A source electrode of the drive transistor DT is coupled with an anode of the OLED. A drain electrode of the drive transistor DT is coupled with a power supply voltage terminal. The power supply voltage terminal is configured to input a power supply voltage ELVDD. A cathode of the OLED receives a low voltage ELVSS.

A gate electrode of the data write transistor T1 is coupled with a gate line Gate. A source electrode of the data write transistor T1 is coupled with a data line Data. A drain electrode of the data write transistor T1 is coupled with a gate electrode of the drive transistor DT.

A first terminal of the storage capacitor CS is coupled with the gate electrode of the drive transistor DT. A second terminal of the storage capacitor CS is coupled with the source electrode of the drive transistor DT.

A gate electrode of the compensation control transistor T2 is coupled with a compensation control line Sc. A source electrode of the compensation control transistor T2 is coupled with the source electrode of the drive transistor DT. A drain electrode of the compensation control transistor T2 is coupled with a detection line SL.

A control terminal of the write control switch SW is coupled with a write control line. A first terminal of the write control switch SW is coupled with a set-voltage write terminal. A second terminal of the write control switch SW is coupled with the detection line SL. The set-voltage write terminal is configured to write a set voltage $V_{PRESL}$.

In the specific embodiment of the pixel circuit shown in FIG. 2A, the drive transistor DT, the data write transistor T1 and the compensation control transistor T2 are n-type thin film transistors, but are not limited thereto.

When the specific embodiment of the pixel circuit shown in FIG. 2A is in operation.

in a set phase, T1 and T2 are turned on, SW controls turning on connection between the set-voltage write terminal and the detection line SL, and a real-time data voltage Vdata in the data line Data is written to the gate electrode of the DT; at this point, a gate-source voltage Vgs of the DT is equal to (Vdata−$V_{PRESL}$).

Figure 2B:
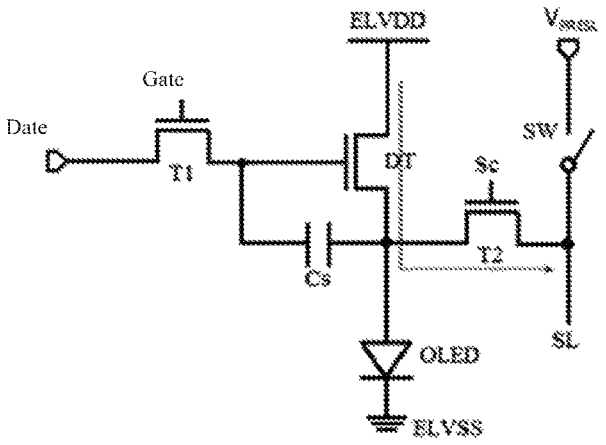
FIG. 2B is a schematic diagram showing current flow in a charging phase of the pixel circuit with compensation function in according to an embodiment of the present disclosure.

In a charging phase, T1 is turned off, T2 is turned on, SW controls turning off the connection between the set-voltage write terminal and the detection line SL, DT is turned on, and a current flowing through the DT is related to Vgs; as shown in FIG. 2B, the current charges the SL (there is parasitic capacitance on the SL) through the turned-on DT and T2. After a preset charging time t, the voltage at the SL is sampled. Mobility of different DTs are different, thus the sampled voltage can reflect the mobility of the DT. Then, a corresponding data voltage compensation variation can be determined according to the sampled voltage.

Figure 2C:
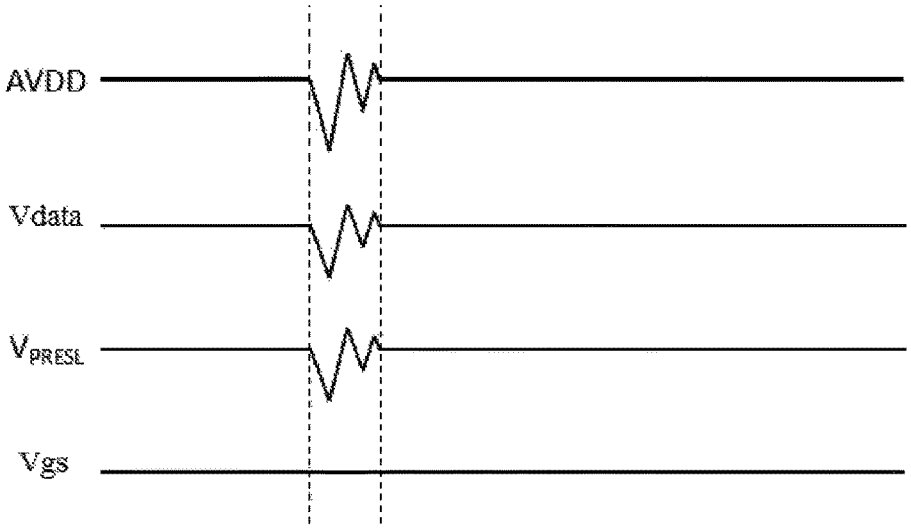
FIG. 2C is a waveform diagram of voltages when a set-voltage generation unit according to an embodiment of the present disclosure is employed.

When the specific embodiment of the pixel circuit shown in FIG. 2A is in operation, in the set phase, Vdata fluctuates due to fluctuation of the gamma main voltage AVDD. When $V_{PRESL}$ is a fixed voltage at this point, the Vgs of DT fluctuates with fluctuation of Vdata, so that the corresponding current flowing through DT is affected by the fluctuation of Vdata, thereby affecting the accuracy of compensation. Thus, as shown in FIG. 2C, in one embodiment of the present disclosure, $V_{PRESL}$ is controlled to be fluctuated with the fluctuation of Vdata, that is, $V_{PRESL}$ and Vdata have the same fluctuation amplitude, so that the gate-source voltage Vgs of the drive transistor DT is independent of the fluctuation of AVDD, and the compensation error caused by the fluctuation of the gamma main voltage AVDD is eliminated, which can effectively reduce the mura (mura refers to the phenomenon of various traces caused by uneven brightness of the display device) or noise caused by the compensation error, thereby ensuring good compensation display performance.

In actual operation, the data drive circuit in the display device obtains the real-time data voltage Vdata according to the gamma main voltage AVDD and the low level VSS, and the total number of gray scales is B, that is, the data drive circuit provides a total of B gray scale voltages (the gray scale voltage is also referred to as the data voltage). The real-time data voltage corresponding to the gray scale 0 is equal to VSS, the real-time data voltage corresponding to the gray scale (B-1) is equal to AVDD, and the real-time data voltage corresponding to the gray scale a is equal to VSS+(AVDD−VSS)×(a+1)/B), then the ratio between the variation V01 of the real-time data voltage corresponding to the gray scale a and the variation V0 of AVDD is the voltage coefficient K. The voltage coefficient K is equal to (a+1)/B. therefore, AVDD fluctuates, and then Vdata fluctuates accordingly.

In specific implementation, VSS may be 0V, a common electrode voltage, or other fixed level, but is not limited thereto.

Specifically, the voltage generation circuit may include an operational amplifier circuit and a voltage division circuit.

The voltage division circuit is configured to divide the gamma main voltage to obtain a divided voltage, and input the divided voltage to a positive input terminal of the operational amplifier circuit.

An inverting input terminal of the operational amplifier circuit is coupled with a reference voltage terminal. The operational amplifier circuit is configured to generate the set voltage according to the divided voltage and a reference voltage input by the reference voltage terminal.

In specific implementation, the set-voltage generation unit in one embodiment of the present disclosure may further include an adjustment circuit.

The adjustment circuit is configured to provide a voltage division adjustment signal to the voltage division circuit according to the real-time data voltage, so that the voltage division circuit controls a ratio between a variation of the divided voltage and the variation V0 of the gamma main voltage to be equal to "b", and then the voltage coefficient K is adjusted accordingly to be (a+1)/B, where "a" represents a gray scale corresponding to the real-time data voltage, "B" represents a total number of gray scales, "B" is a positive integer, and "a" is 0 or a positive integer less than "B".

In one embodiment of the present disclosure, when the voltage generation circuit includes the voltage division circuit and the operational amplifier circuit, the adjustment circuit adjusts the voltage coefficient K by providing a voltage division adjustment signal to the voltage division circuit to adjust the divided voltage accordingly.

In specific implementation, the reference voltage may be a fixed voltage, for example, the reference voltage may be 0V or a low voltage, but is not limited thereto.

Figure 3:
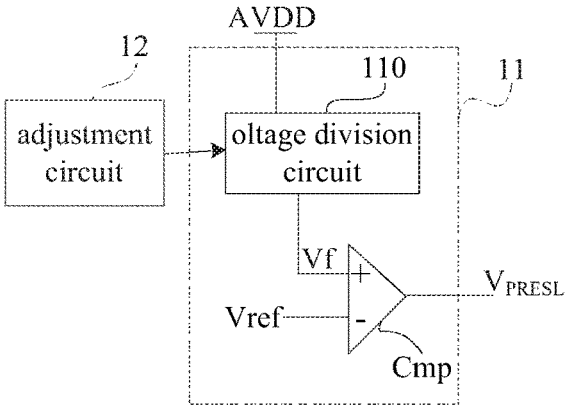
FIG. 3 is a schematic diagram of a set-voltage generation unit according to another embodiment of the present disclosure.

As shown in FIG. 3, on the basis of the embodiment of the set-voltage generation unit shown in FIG. 1, the voltage generation circuit 11 includes an operational amplifier circuit Cmp and a voltage division circuit 110.

The voltage division circuit 110 is configured to divide the gamma main voltage AVDD to obtain a divided voltage Vf, and input the divided voltage Vf to a positive input terminal of the operational amplifier circuit Cmp.

An inverting input terminal of the operational amplifier circuit Cmp is coupled with a reference voltage terminal for inputting a reference voltage Vref. The operational amplifier circuit Cmp is configured to generate the set voltage according to the divided voltage Vf and the reference voltage Vref input by the reference voltage terminal.

The adjustment circuit 12 is configured to provide a voltage division adjustment signal to the voltage division circuit 110 according to the real-time data voltage Vdata and the gamma main voltage AVDD, so that the voltage division circuit 10 controls a ratio between a variation of the divided voltage and the variation V0 of the gamma main voltage to be equal to b, and then the voltage coefficient K is adjusted accordingly.

In one embodiment of the present disclosure, as shown in FIG. 3, when the voltage generation circuit 11 includes the voltage division circuit 110 and the operational amplifier circuit Cmp. The adjustment circuit 12 provides a voltage division adjustment signal to the voltage division circuit 110. The voltage coefficient K is adjusted by controlling the ratio between the amount of change in the divided voltage Vf and the amount of change V0 of the gamma main voltage to be b.

When the embodiment of the set-voltage generation unit shown in FIG. 3 is in operation, the voltage division circuit 110 divides AVDD to obtain a divided voltage Vf, Vf=V1+b×(AVDD−V1), where "b" is a voltage division coefficient, V1 is a first voltage, and "b" is 0 or a positive number less than or equal to 1.

The set voltage generated by the operational amplifier circuit Cmp is equal to A×(Vf−Vref), and the ratio between the variation of the divided voltage Vf and the variation of AVDD is "b".

From the above, K is equal to b×A, where A is an amplification factor of the operational amplifier circuit.

According to one specific embodiment, the voltage division circuit may include a first voltage division resistor and a second voltage division resistor.

A first end of the first voltage division resistor receives the gamma main voltage. A second end of the first voltage division resistor is coupled with the positive input terminal of the operational amplifier circuit.

A first end of the second voltage division resistor is coupled with the positive input terminal. A second end of the second voltage division resistor is coupled with the first voltage terminal.

Resistance values of the first voltage division resistor and the second voltage division resistor can be adjusted.

The first voltage terminal is configured to input the first voltage V1. In specific implementation, the first voltage terminal may be a ground terminal or a low voltage terminal, but is not limited thereto.

Figure 4:
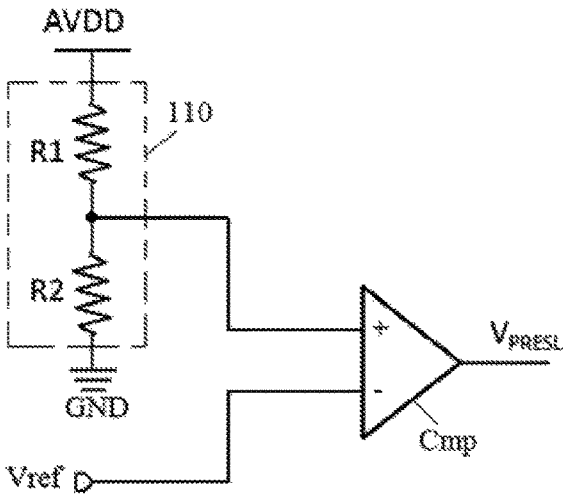
FIG. 4 is a circuit diagram of a voltage generation circuit in the set-voltage generation unit according to an embodiment of the present disclosure.

As shown in FIG. 4, the voltage division circuit 110 may include a first voltage division resistor R1 and a second voltage division resistor R2.

A first end of the first voltage division resistor R1 receives the gamma main voltage AVDD. A second end of the first voltage division resistor R1 is coupled with the positive input terminal of the operational amplifier circuit Cmp.

A first end of the second voltage division resistor R2 is coupled with the positive input terminal of the operational amplifier circuit Cmp. A second end of the second voltage division resistor R2 is coupled with the ground terminal GND.

A resistance value Rz1 of the first voltage division resistor R1 and a resistance value Rz2 of the second voltage division resistor R2 can be adjusted, thereby adjusting the divided voltage Vf.

In the embodiment shown in FIG. 4, V1 is equal to zero.

When the embodiment of the set-voltage generation unit shown in FIG. 4 is in operation, Vf is equal to AVDD×Rz2/(Rz1+Rz2), and Vf can be adjusted by adjusting Rz1 and Rz2. The voltage division coefficient b is equal to Rz2/(Rz1+Rz2). The voltage coefficient K is equal to b×A, where A is an amplification factor of the operational amplifier circuit Cmp.

In specific implementation, the voltage division adjustment signal may include a resistance value adjustment signal.

The adjustment circuit 12 is configured to transmit a resistance value adjustment signal to the first voltage division resistor R1 and/or the second voltage division resistor R2 according to the real-time data voltage Vdata and the gamma main voltage AVDD, to control adjustment of the resistance value Rz1 of the first voltage division resistor R1 and/or the resistance value Rz2 of the second voltage division resistor R2, thereby adjusting the voltage coefficient K.

Rz2/(Rz1+Rz2) is equal to the voltage division coefficient b.

The set-voltage generation unit of the present disclosure will be described hereinafter with a specific embodiment.

Figure 5:
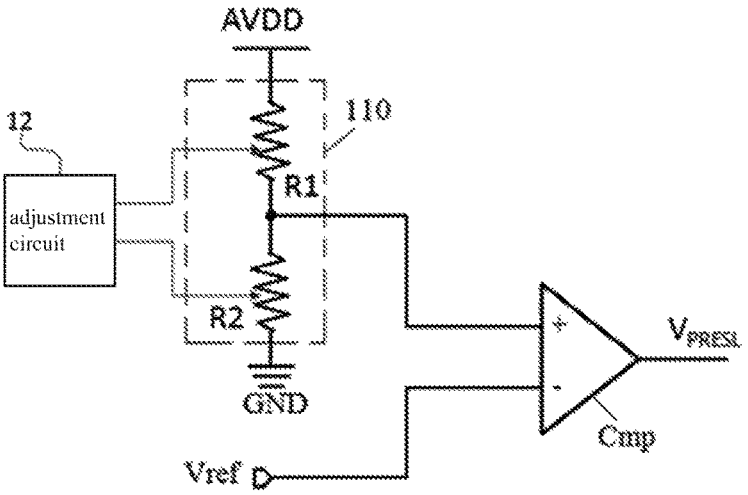
FIG. 5 is a circuit diagram of a set-voltage generation unit according to an embodiment of the present disclosure.

As shown in FIG. 5, a specific embodiment of the set-voltage generation unit of the present disclosure includes a voltage generation circuit and an adjustment circuit 12.

The voltage generation circuit includes an operational amplifier circuit Cmp and a voltage division circuit 110. The voltage division circuit 110 includes a first voltage division resistor R1 and a second voltage division resistor R2.

An inverting input terminal of the operational amplifier circuit Cmp is coupled with a reference voltage terminal for inputting a reference voltage Vref. The operational amplifier circuit Cmp is configured to generate a set voltage $V_{PRESL}$ according to a divided voltage Vf and the reference voltage Vref input by the reference voltage terminal.

A first end of the first voltage division resistor R1 receives a gamma main voltage AVDD. A second end of the first voltage division resistor R1 is coupled with the positive input terminal of the operational amplifier circuit Cmp.

A first end of the second voltage division resistor R2 is coupled with the positive input terminal of the operational amplifier circuit Cmp. A second end of the second voltage division resistor R2 is coupled with a ground terminal GND.

The voltage division adjustment signal includes a resistance value adjustment signal.

The adjustment circuit 12 is configured to transmit the resistance value adjustment signal to the first voltage division resistor R1 and/or the second voltage division resistor R2 according to the real-time data voltage Vdata and the gamma main voltage AVDD to control adjustment of the resistance value Rz1 of the first voltage division resistor R1 and/or the resistance value Rz2 of the second voltage division resistor R2, thereby adjusting the divided voltage Vf.

When this embodiment of the set-voltage generation unit of the present disclosure is in operation, $V_{PRESL}$A×(Vf−Vref), where Vf is equal to AVDD×Rz2/(Rz1+Rz2), "A" is an amplification factor and "A" is a positive number. Then, a variation of $V_{PRESL}$ is equal to A×Rz2/(Rz1+Rz2) times the variation of AVDD, that is, the voltage coefficient K is equal to A×Rz2/(Rz1+Rz2).

When the specific embodiment of the set-voltage generation unit of the present disclosure is in operation, if a data drive circuit outputs 256 gray scale voltages (the gray scale voltage is also referred to as a data voltage) and the real-time data voltage Vdata corresponds to the gray scale 127, the adjustment circuit 12 controls the adjustment of Rz1 and/or Rz2 so that A×Rz2/(Rz1+Rz2)=1/2. As this point, the voltage coefficient K (which is a ratio between a variation V01 of the set voltage and a variation V0 of the gamma main voltage AVDD) is equal to 1/2.

When the data drive circuit outputs 256 gray scale voltages (the gray scale voltage is also referred to as the data voltage) and the real-time data voltage Vdata corresponds to the gray scale 63, the adjustment circuit 12 controls the adjustment of Rz1 and/or Rz2 so that AxRz2/(Rz1+Rz2)=1/4. At this point, the voltage coefficient K (which is the ratio between the variation V01 of the set voltage and the variation V0 of the gamma main voltage AVDD) is equal to 1/4.

When the data drive circuit outputs 256 gray scale voltages (the gray scale voltage is also referred to as the data voltage) and the real-time data voltage Vdata corresponds to the gray scale 20, the adjustment circuit 12 controls the adjustment of Rz1 and/or Rz2 so that A×Rz2/(Rz1+Rz2)=21/256. At this point, the voltage coefficient K (which is the ratio between the variation V01 of the set voltage and the variation V0 of the gamma main voltage AVDD) is equal to 21/256.

A set-voltage generation method according to an embodiment of the present disclosure is applied to the above set-voltage generation unit. The set-voltage generation method includes:

generating, by the voltage generation circuit, a set voltage according to a gamma main voltage so that a ratio between a variation V01 of the set voltage and a variation V0 of the gamma main voltage is a voltage coefficient K, where K is a positive number less than or equal to 1.

The set-voltage generation method according to one embodiment of the present disclosure uses the voltage generation circuit to generate the set voltage according to the gamma main voltage, so that the variation of the set voltage is proportional to the variation (i.e., fluctuation value) of the gamma main voltage, that is, the ratio between the variation V01 of the set voltage and the variation V0 of the gamma main voltage is the voltage coefficient K. In this way, the variation of the set voltage is equal to a variation of a real-time data voltage caused by jitter of the gamma main voltage, which can eliminate the compensation error caused by fluctuation of the gamma main voltage AVDD and ensure a good compensation display performance.

Specifically, the set-voltage generation unit may further include an adjustment circuit.

Figure 6:
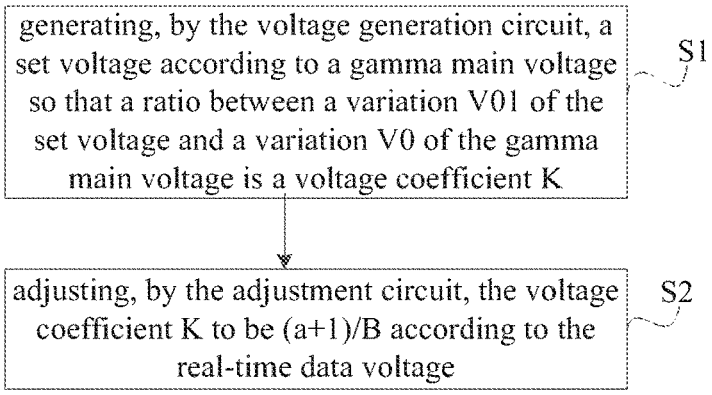
FIG. 6 is a flowchart of a set-voltage generation method according to an embodiment of the present disclosure.

As shown in FIG. 6, a set-voltage generation method according to one embodiment of the present disclosure is applied to the set-voltage generation unit. The set-voltage generation method includes:

S1: generating, by the voltage generation circuit, a set voltage according to a gamma main voltage so that a ratio between a variation V01 of the set voltage and a variation V0 of the gamma main voltage is a voltage coefficient K, where K is a positive number less than or equal to 1;

S2: adjusting, by the adjustment circuit, the voltage coefficient K to be (a+1)/B according to the real-time data voltage; where "a" represents a gray scale corresponding to the real-time data voltage, "B" represents a total number of gray scales, "a" is 0 or a positive integer less than "B".

In specific implementation, the set-voltage generation unit may further include the adjustment circuit that adjusts the voltage coefficient K to be equal to (a+1)/B, so that the variation of the set voltage is equal to the variation of the real-time data voltage caused by jitter of the gamma main voltage.

Specifically, the voltage generation circuit may include an operational amplifier circuit and a voltage division circuit. The step of generating, by the voltage generation circuit, a set voltage according to a gamma main voltage, may include:

dividing, by the voltage division circuit, the gamma main voltage to obtain a divided voltage, and inputting the divided voltage to a positive input terminal of the operational amplifier circuit;

generating, by the operational amplifier circuit, the set voltage according to the divided voltage and a reference voltage input by the reference voltage terminal.

Specifically, the set-voltage generation unit may further include an adjustment circuit. The set-voltage generation method may further include:

providing, by the adjustment circuit, a voltage division adjustment signal to the voltage division circuit according to the real-time data voltage, so that the voltage division circuit controls a ratio between a variation of the divided voltage and the variation V0 of the gamma main voltage to be equal to "b", and then the voltage coefficient K is adjusted accordingly to be (a+1)/B; where "a" represents a gray scale corresponding to the real-time data voltage, "B" represents a total number of gray scales, "B" is a positive integer, and "a" is 0 or a positive integer less than "B", "b" represents a voltage division coefficient and is equal to K/A, and A is an amplification factor of the operational amplifier circuit.

In specific implementation, the set-voltage generation unit may further include the adjustment circuit that provides the voltage division adjustment signal to the voltage division circuit, to control adjustment of the voltage division coefficient b of the voltage division circuit, thereby adjusting the voltage coefficient K to be (a+1)/B.

In specific implementation, the voltage division circuit may include a first voltage division resistor and a second voltage division resistor. The voltage division adjustment signal may include a resistance value adjustment signal. The step of providing, by the adjustment circuit, a voltage division adjustment signal to the voltage division circuit according to the real-time data voltage, so that the voltage division circuit controls a ratio between a variation of the divided voltage and the variation V0 of the gamma main voltage to be equal to "b", and then the voltage coefficient K is adjusted accordingly to be (a+1)/B, may include:

transmitting, by the adjustment circuit, the resistance value adjustment signal to the first voltage division resistor and/or the second voltage division resistor according to the real-time data voltage, to control adjustment of the resistance value Rz1 of the first voltage division resistor and/or the resistance value Rz2 of the second voltage division resistor, thereby adjusting the voltage coefficient K, where Rz2/(Rz1+Rz2) is equal to the voltage division coefficient b.

A display device according to one embodiment of the present disclosure includes M rows and N columns of pixel circuits and N set-voltage generation units described above.

An n-th set-voltage generation unit is coupled with the pixel circuits in the n-th column, and is configured to provide a set voltage for the pixel circuits in the n-th column, where both M and N are integers greater than 1, and n is a positive integer less than or equal to N.

In the display device according to one embodiment of the present disclosure, the pixel circuits in an identical column are coupled with one set-voltage generation unit, and rows of gate lines and rows of write control lines are turned on row by row to write in a time division manner a real-time data voltage at a data line in a corresponding column to pixel circuits in different rows, and control a detection line in a corresponding column to receive in a time division manner the set voltages in different rows of the corresponding column.

Specifically, the display device of one embodiment of the present disclosure may further include a display substrate and a drive integrated circuit. The pixel circuits are disposed at a display area of the display substrate.

The set-voltage generation units are disposed at a peripheral area of the display substrate, or the set-voltage generation units are disposed in the drive integrated circuit.

In the display device according to one embodiment of the present disclosure, the set-voltage generation units may be disposed at the peripheral area of the display substrate, or may be disposed in a drive integrated circuit (IC), and pixel circuits in one column share one set-voltage generation unit.

In specific implementation, the display device of the present disclosure may further include N columns of detection lines, M rows of gate lines, N columns of data lines, M rows of compensation control lines and M rows of write control lines. The gate line is configured to output a gate drive signal. The data line is configured to output a real-time data voltage. The compensation control line is configured to input a compensation control signal. The write control line is configured to input a write control signal.

A pixel circuit in an m-th row and an n-th column includes a light emitting element in the m-th row and the n-th column, a drive circuit in the m-th row and the n-th column, a display control circuit in the m-th row and the n-th column, a compensation control circuit in the m-th row and the n-th column, and a set-voltage write control circuit in the m-th row and the n-th column.

The drive circuit in the m-th row and the n-th column is configured to, under control of a control terminal thereof, drive the light emitting element in the m-th row and the n-th column.

The display control circuit in the m-th row and the n-th column is coupled with the control terminal of the drive circuit in the m-th row and the n-th column; and is configured to, under control of a gate drive signal output by the gate line in the m-th row, perform display driving control on the drive circuit in the m-th row and the n-th column according to the real-time data voltage of the data line in the n-th column.

The compensation control circuit in the m-th row and the n-th column is configured to, under control of a compensation control signal input by the compensation control line in the m-th row, control a first terminal of the drive circuit in the m-th row and the n-th column to be coupled with the detection line in the n-th column.

The set-voltage write control circuit in the m-th row and the n-th column is configured to, under control of a write control signal input by the write control line in the m-th row, control a set-voltage write terminal in the m-th row and the n-th column to be coupled with the detection line in the n-th column.

The n-th set-voltage generation unit is configured to write a set voltage in the m-th row and the n-th column to the set-voltage write terminal in the m-th row and the n-th column, to control writing the set voltage in the m-th row and the n-th column to the detection line in the n-th column when the set-voltage write control circuit in the m-th row and the n-th column controls the set-voltage write terminal in the m-th row and the n-th column to be coupled with the detection line in the n-th column; where m is a positive integer less than or equal to M.

Specifically, the light emitting element in the m-th row and the n-th column may be an organic light-emitting diode, but not limited thereto.

Figure 7:
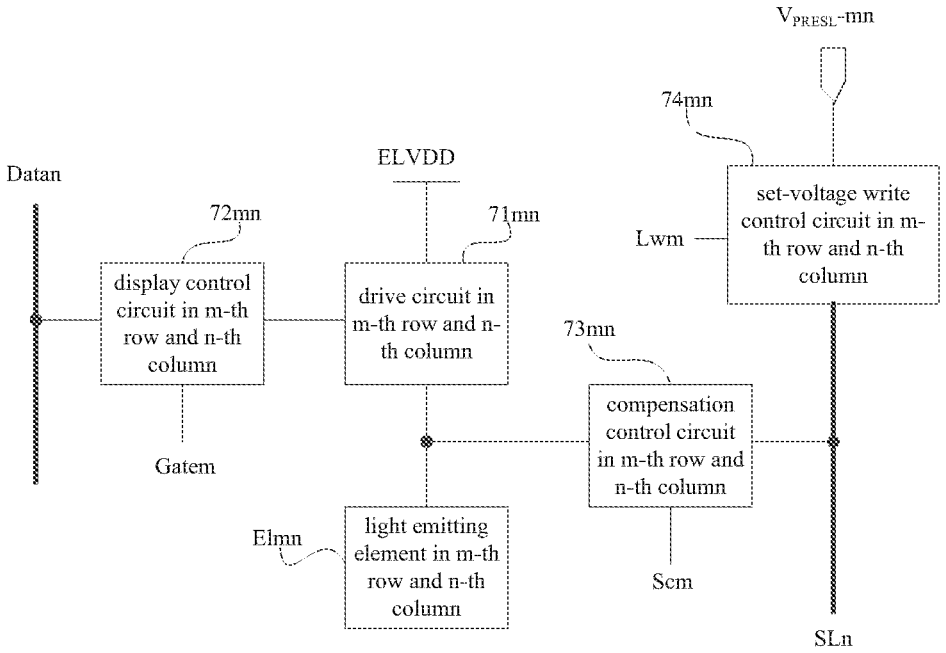
FIG. 7 is a schematic diagram of a pixel circuit in m-th row and n-th column of a display device according to an embodiment of the present disclosure.

As shown in FIG. 7, a pixel circuit in an m-th row and an n-th column according to one embodiment may include a light emitting element ELmn in the m-th row and the n-th column, a drive circuit 71*mn* in the m-th row and the n-th column, a display control circuit 72*mn* in the m-th row and the n-th column, a compensation control circuit 73*mn* in the m-th row and the n-th column, and a set-voltage write control circuit 74*mn* in the m-th row and the n-th column.

A first terminal of the drive circuit 71*mn* in the m-th row and the n-th column is coupled with a first terminal of the light emitting element ELmn in the m-th row and the n-th column. A second terminal of the drive circuit 71*mn* in the m-th row and the n-th column is coupled with a power supply voltage terminal for inputting a power supply voltage ELVDD. The drive circuit 71*mn* in the m-th row and the n-th column is configured to, under control of a control terminal thereof, drive the light emitting element ELmn in the m-th row and the n-th column. A second terminal of the light emitting element ELmn in the n-th column receives a low voltage ELVSS.

A control terminal of the display control circuit 72*mn* in the m-th row and the n-th column is coupled with a gate line Gatem in the m-th row. A first terminal of the display control circuit 72*mn* in the m-th row and the n-th column is coupled with a data line Datan in the n-th column. A second terminal of the display control circuit 72*mn* in the m-th row and the n-th column is coupled with the control terminal of the drive circuit 71*mn* in the m-th row and the n-th column. The display control circuit 72*mn* in the m-th row and the n-th column is configured to, under control of a gate drive signal output by the gate line Gatem in the m-th row, perform display driving control on the drive circuit 71*mn* in the m-th row and the n-th column according to the real-time data voltage Vdatamn of the data line Datan in the n-th column.

A control terminal of the compensation control circuit 73*mn* in the m-th row and the n-th column is coupled with a compensation control line Scm in the m-th row. A first terminal of the compensation control circuit 73*mn* in the m-th row and the n-th column is coupled with the first terminal of the drive circuit 71*mn* in the m-th row and the n-th column. A second terminal of the compensation control circuit 73*mn* in the m-th row and the n-th column is coupled with the detection line SLn in the n-th column. The compensation control circuit 73*mn* in the m-th row and the n-th column is configured to, under control of a compensation control signal input by the compensation control line Scm in the m-th row, control the first terminal of the drive circuit 71*mn* in the m-th row and the n-th column to be coupled with the detection line SLn in the n-th column.

A control terminal of the set-voltage write control circuit 74*mn* in the m-th row and the n-th column is coupled with a write control line Lwm in the m-th row. A first terminal of the set-voltage write control circuit 74*mn* in the m-th row and the n-th column is coupled with the set-voltage write terminal in the m-th row and the n-th column. A second terminal of the set-voltage write control circuit 74*mn* in the m-th row and the n-th column is coupled with the detection line SLn in the n-th column. The set-voltage write control circuit 74*mn* in the m-th row and the n-th column is configured to, under control of a write control signal input by the write control line Lwm in the m-th row, control the set-voltage write terminal in the m-th row and the n-th column to be coupled with the detection line SLn in the n-th column, thereby enabling the set-voltage write terminal in the m-th row and the n-th column to write a set voltage $V_{PRESL}$-mn in the m-th row and the n-th column to the detection line SLn in the n-th column.

The n-th set-voltage generation unit included in the display device according to one embodiment of the present disclosure is configured to write the set voltage $V_{PRES}$-mn in the m-th row and the n-th column to the set-voltage write terminal in the m-th row and the n-th column, where in is a positive integer less than or equal to M.

When the embodiment of the pixel circuit in the m-th row and the n-th column shown in FIG. 7 is in operation.

in a set phase for the m-th row and the n-th column, the n-th set-voltage generation unit writes the set voltage $V_{PRESL}$-mn in the m-th row and the n-th column to the set-voltage write terminal in the m-th row and the n-th column; under control of the gate drive signal output by the gate line Gatem in the m-th row, the display control circuit 72*mn* in the m-th row and the n-th column writes the real-time data voltage Vdatamn of the data line Datan in the n-th column to the control terminal of the drive circuit 71*mn* in the m-th row and the n-th column; under control of a compensation control signal input by the compensation control line Scm in the m-th row, the compensation control circuit 73*mn* in the m-th row and the n-th column controls the first terminal of the drive circuit 71*mn* in the m-th row and the n-th column to be coupled with the detection line SLn in the n-th column; under control of a write control signal input by the write control line Lwm in the m-th row, the set-voltage write control circuit 74*mn* in the m-th row and the n-th column controls the set-voltage write terminal in the m-th row and the n-th column to be coupled with the detection line SLn in the n-th column, thereby enabling the set-voltage write terminal in the m-th row and the n-th column to write a set voltage $V_{PRESL}$-mn in the m-th row and the n-th column to the detection line SLn in the n-th column, and then writing the set voltage $V_{PRESL}$-mn in the m-th row and the n-th column to the first terminal of the drive circuit 71*mn* in the m-th row and the n-th column. At this point, a voltage at the control terminal of the drive circuit 71*mn* in the m-th row and the n-th column is Vdatamn, and a voltage at the first terminal of the drive circuit 71*mn* in the m-th row and the n-th column is $V_{PRESL}$-mn.

In a charging phase for the m-th row and the n-th column, under control of the gate drive signal output by the gate line in the m-th row, the display control circuit 72*mn* in the m-th row and the n-th column turns off the connection between the data line Datan in the n-th column and the control terminal of the drive circuit 71*mn* in the m-th row and the n-th column; under control of the write control signal input by the write control line Lwm in the m-th row, the set-voltage write control circuit 74*mn* in the m-th row and the n-th column controls turning off the connection between the set-voltage write terminal in the m-th row and the n-th column and the detection line SLn in the n-th column; under control of a compensation control signal input by the compensation control line Scm in the m-th row, the compensation control circuit 73*mn* in the m-th row and the n-th column controls the first terminal of the drive circuit 71*mn* in the m-th row and the n-th column to be coupled with the detection line SLn in the n-th column; the drive circuit 71*mn* in the m-th row and the n-th column controls turning on connection between the power supply voltage terminal and the first terminal of the compensation control circuit 73*mn* in the m-th row and the n-th column, so that current flows through the drive circuit 71*mn* in the m-th row and the n-th column and the compensation control circuit 73*mn* in the m-th row and the n-th column, and charges the detection line SLn (there is parasitic capacitance on the SLn) in the n-th column; after a preset charging time t, the voltage at the SLn is sampled, and then the data voltage is compensated according to the sampled voltage.

When the embodiment of the pixel circuit in the m-th row and the n-th column shown in FIG. 7 is in operation, in the set phase for the m-th row and the n-th column, the n-th set-voltage generation unit writes the set voltage $V_{PRESL}$-mn in the in-th row and the n-th column to the set-voltage write terminal in the m-th row and the n-th column, so that the variation of the set voltage $V_{PRESL}$-mn is equal to the variation of the real-time data voltage Vdatanm caused by jitter of the gamma main voltage AVDD, thereby improving the compensation accuracy.

Specifically, the compensation control circuit in the in-th row and the n-th column may include a compensation control transistor in the m-th row and the n-th column; and the set-voltage write control circuit in the in-th row and the n-th column may include a write control switch in the m-th row and the n-th column.

A control electrode of the compensation control transistor in the m-th row and the n-th column is coupled with the compensation control line in the m-th row. A first electrode of the compensation control transistor in the m-th row and the n-th column is coupled with the first terminal of the drive circuit in the m-th row and the n-th column. A second electrode of the compensation control transistor in the m-th row and the n-th column is coupled with the detection line SLn in the n-th column.

A control terminal of the write control switch in the m-th row and the n-th column is coupled with the write control line in the m-th row. A first terminal of the write control switch in the m-th row and the n-th column is coupled with the set-voltage write terminal in the m-th row and the n-th column. A second terminal of the write control switch in the m-th row and the n-th column is coupled with the detection line in the n-th column.

Specifically, the drive circuit in the m-th row and the n-th column may include a drive transistor in the m-th row and the n-th column; and the display control circuit in the in-th row and the n-th column may include a data write transistor in the m-th row and the n-th column, and a storage capacitor in the m-th row and the n-th column.

A gate electrode of the drive transistor in the m-th row and the n-th column is the control terminal of the drive circuit in the m-th row and the n-th column.

A gate electrode of the data write transistor in the m-th row and the n-th column is coupled with the gate line in the m-th row. A first electrode of the data write transistor in the m-th row and the n-th column is coupled with the data line in the n-th column. A second electrode of the data write transistor in the m-th row and the n-th column is coupled with the gate electrode of the drive transistor in the m-th row and the n-th column.

A first electrode of the drive transistor in the m-th row and the n-th column is coupled with the light emitting element in the m-th row and the n-th column, A second electrode of the drive transistor in the m-th row and the n-th column is coupled with the power supply voltage terminal.

A first terminal of the storage capacitor in the m-th row and the n-th column is coupled with the gate electrode of the drive transistor in the m-th row and the n-th column. A second terminal of the storage capacitor in the m-th row and the n-th column is coupled with the first electrode of the drive transistor in the m-th row and the n-th column.

The pixel circuit in the m-th row and the n-th column included in the display device of the present disclosure will be described hereinafter with a specific embodiment.

Figure 8:
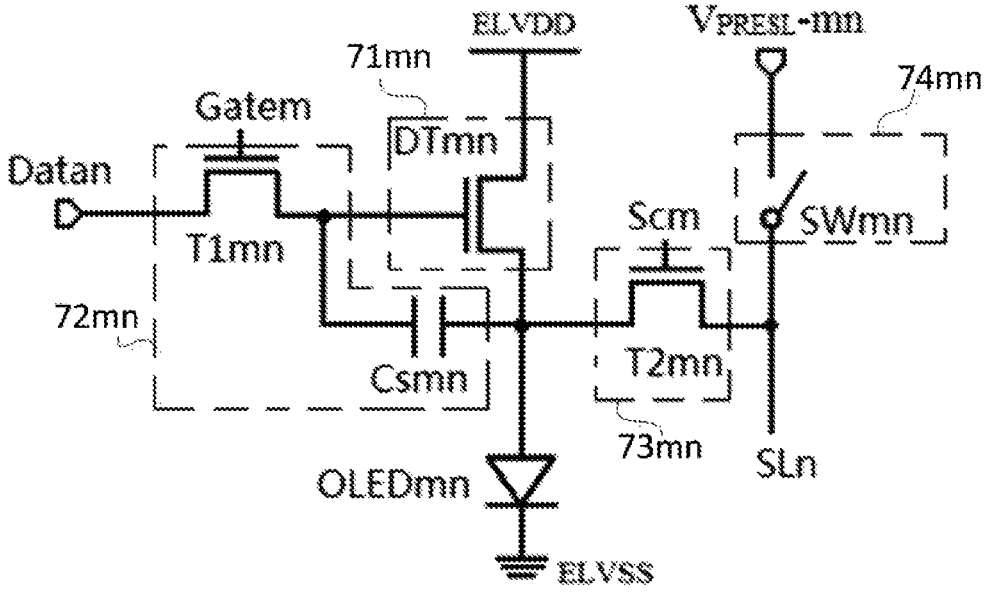
FIG. 8 is a circuit diagram of a pixel circuit in m-th row and n-th column of a display device according to an embodiment of the present disclosure.

As shown in FIG. 8, the pixel circuit in the m-th row and the n-th column according to a specific embodiment includes an organic light emitting diode OLEDmn in the m-th row and the n-th column, a drive circuit 71*mn* in the m-th row and the n-th column, a display control circuit 72*mn* in the m-th row and the n-th column, a compensation control circuit 73*mn* in the m-th row and the n-th column, and a set-voltage write control circuit 74*mn* in the m-th row and the n-th column.

The compensation control circuit 73*mn* in the m-th row and the n-th column includes a compensation control transistor T2*mn* in the m-th row and the n-th column. The set-voltage write control circuit 74*mn* in the m-th row and the n-th column includes a write control switch SWmn in the m-th row and the n-th column. The drive circuit 71*mn* in the m-th row and the n-th column includes a drive transistor DTmn in the m-th row and the n-th column. The display control circuit 72*mn* in the m-th row and the n-th column includes a data write transistor T1*mn* in the m-th row and the n-th column, and a storage capacitor Csmn in the m-th row and the n-th column.

A gate electrode of the compensation control transistor T2*mn* in the m-th row and the n-th column is coupled with the compensation control line Scm in the m-th row. A source electrode of the compensation control transistor T2*mn* in the m-th row and the n-th column is coupled with a source electrode of the drive transistor in the m-th row and the n-th column. A drain electrode of the compensation control transistor T2*mn* in the m-th row and the n-th column is coupled with the detection line SLn in the n-th column.

A control terminal of the write control switch SWmn in the m-th row and the n-th column is coupled with the write control line in the m-th row. A first terminal of the write control switch SWmn in the m-th row and the n-th column is coupled with the set-voltage write terminal in the m-th row and the n-th column. A second terminal of the write control switch SWmn in the m-th row and the n-th column is coupled with the detection line SLn in the n-th column.

A gate electrode of the drive transistor DTmn in the m-th row and the n-th column is the control terminal of the drive circuit in the m-th row and the n-th column.

A gate electrode of the data write transistor T1*mn* in the m-th row and the n-th column is coupled with the gate line Gatem in the m-th row. A source electrode of the data write transistor T1*mn* in the m-th row and the n-th column is coupled with the date line Datan in the n-th column. A drain electrode of the data write transistor T1*mn* in the m-th row and the n-th column is coupled with the gate electrode of the drive transistor DTmn in the m-th row and the n-th column.

A source electrode of the drive transistor DTmn in the m-th row and the n-th column is coupled with an anode of the organic light emitting diode OLEDmn in the m-th row and the n-th column. A drain electrode of the drive transistor DTmn in the m-th row and the n-th column is coupled with a power supply voltage terminal for inputting a power supply voltage ELVDD. A cathode of the organic light emitting diode OLEDmn in the m-th row and the n-th column receives the low voltage ELVSS.

A first terminal of the storage capacitor Csmn in the m-th row and the n-th column is coupled with the gate electrode of the drive transistor DTmn in the m-th row and the n-th column, A second terminal of the storage capacitor Csmn in the m-th row and the n-th column is coupled with the source electrode of the drive transistor DTmn in the m-th row and the n-th column.

The n-th set-voltage generation unit included in the display device according to one embodiment of the present disclosure is configured to write the set voltage $V_{PRESL}$-mn in the m-th row and the n-th column to the set-voltage write terminal in the m-th row and the n-th column.

In the specific embodiment of the pixel circuit in the m-th row and the n-th column shown in FIG. 8, all of the transistors are n-type thin film transistors, but are not limited thereto.

When the embodiment of the pixel circuit in the m-th row and the n-th column shown in FIG. 8 is in operation, in a set phase for the m-th row and the n-th column, the n-th set-voltage generation unit writes the set voltage $V_{PRESL}$-mn in the m-th row and the n-th column to the set-voltage write terminal in the m-th row and the n-th column; under control of the gate drive signal output by the gate line Gatem in the m-th row, the data write transistor T1*mn* in the m-th row and the n-th column is turned on, so that the real-time data voltage Vdatamn at the data line Datan in the n-th column is written to the gate electrode of the drive transistor DTmn in the m-th row and the n-th column. Under control of a compensation control signal input by the compensation control line Scm in the m-th row, the compensation control transistor T2*mn* in the m-th row and the n-th column is turned on, to control the source electrode of the drive transistor DTmn in the m-th row and the n-th column to be coupled with the detection line SLn in the n-th column. Under control of a write control signal input by the write control line in the m-th row, the write control switch SWmn in the m-th row and the n-th column is turned on, to control the set-voltage write terminal in the m-th row and the n-th column to be coupled with the detection line SLn in the n-th column, thereby enabling the set-voltage write terminal in the m-th row and the n-th column to write the set voltage $V_{PRESL}$-mn in the m-th row and the n-th column to the detection line SLn in the n-th column, and then writing the set voltage $V_{PRESL}$-mn in the m-th row and the n-th column to the source electrode of the drive transistor DTmn in the m-th row and the n-th column. At this point, a voltage at the gate electrode of the drive transistor DTmn in the m-th row and the n-th column is Vdatamn; a voltage at the source electrode of the drive transistor DTmn in the m-th row and the n-th column is $V_{PRESL}$-mn; and a gate-source voltage Vgs of the drive transistor DTmn in the m-th row and the n-th column is Vdatamn-$V_{PRESL}$-mn.

In a charging phase for the m-th row and the n-th column, under control of the gate drive signal output by the gate line in the m-th row, the data write transistor T1*mn* in the m-th row and the n-th column is turned off, to turn off the connection between the data line Datan in the n-th column and the gate electrode of the drive transistor DTmn in the m-th row and the n-th column. Under control of the write control signal input by the write control line in the m-th row, the write control switch SWmn in the m-th row and the n-th column controls turning off the connection between the set-voltage write terminal in the m-th row and the n-th column and the detection line SLn in the n-th column. Under control of a compensation control signal input by the compensation control line Scm in the m-th row, the compensation control transistor T2*mn* in the m-th row and the n-th column is turned on, to control the source electrode of the drive transistor DTmn in the m-th row and the n-th column to be coupled with the detection line SLn in the n-th column. The drive transistor DTmn in the m-th row and the n-th column is turned on, to control turning on the connection between the power supply voltage terminal and the source electrode of the compensation control transistor T2*mn* in the m-th row and the n-th column, so that current flows through the drive transistor DTmn in the m-th row and the n-th column and the compensation control transistor T2*mn* in the m-th row and the n-th column to charge the detection line SLn (there is parasitic capacitance on the SLn) in the n-th column; after a preset charging time t, the voltage at the SLn is sampled, and then the data voltage is compensated according to the sampled voltage.

When the embodiment of the pixel circuit in the m-th row and the n-th column shown in FIG. 8 is in operation, in the set phase for the m-th row and the n-th column, the n-th set-voltage generation unit writes the set voltage $V_{PRESL}$-mn in the m-th row and the n-th column to the set-voltage write terminal in the m-th row and the n-th column, so that the variation of the set voltage $V_{PRESL}$-mn is equal to the variation of the real-time data voltage Vdatanm caused by jitter of the gamma main voltage AVDD, thereby improving the compensation accuracy.

The display device provided in the embodiment of the present disclosure may be any product or component having a display function, such as a mobile phone, a tablet computer, a television, a display monitor, a notebook computer, a digital photo frame, and a navigator.

The above are merely the optional embodiments of the present disclosure. It should be noted that, a person skilled in the art may make improvements and modifications without departing from the principle of the present disclosure, and these improvements and modifications shall also fall within the scope of the present disclosure.

The invention claimed is:

1. A display device comprising: M rows and N columns of pixel circuits and N set-voltage generation units;

wherein the set-voltage generation unit includes a voltage generation circuit; the set-voltage generation unit is configured to generate a set voltage according to a gamma main voltage such that a ratio between a variation of the set voltage and a variation of the gamma main voltage is a voltage coefficient K, and K is a positive number less than or equal to 1;

an output terminal of an n-th set-voltage generation unit is coupled with pixel circuits in the n-th column, and is configured to provide the set voltage for the pixel circuits in the n-th column;

wherein both M and N are integers greater than 1, n is a positive integer less than or equal to N;

wherein the voltage generation circuit includes an operational amplifier circuit and a voltage division circuit;

the voltage division circuit is configured to divide the gamma main voltage to obtain a divided voltage, and input the divided voltage to a positive input terminal of the operational amplifier circuit;

an inverting input terminal of the operational amplifier circuit is coupled with a reference voltage terminal; the operational amplifier circuit is configured to generate the set voltage according to the divided voltage and a reference voltage input by the reference voltage terminal.

2. The display device according to claim 1, further comprising a display substrate;

wherein the pixel circuits are disposed at a display area of the display substrate; and the set-voltage generation units are disposed at a peripheral area of the display substrate.

3. The display device according to claim 1, further comprising a display substrate and a drive integrated circuit;

wherein the pixel circuits are disposed at a display area of the display substrate; and the set-voltage generation units are disposed in the drive integrated circuit.

4. The display device according to claim 1, wherein the set-voltage generation unit further includes an adjustment circuit;

the adjustment circuit is configured to adjust the voltage coefficient K to be (a+1)/B according to the real-time data voltage, wherein "a" represents a gray scale corresponding to a real-time data voltage, "B" represents a total number of gray scales, "a" is 0 or a positive integer less than "B", and "B" is a positive integer.

5. The display device according to claim 1, wherein the set-voltage generation unit further includes an adjustment circuit;

the adjustment circuit is configured to provide a voltage division adjustment signal to the voltage division circuit according to the real-time data voltage, so that the voltage division circuit controls a ratio between a variation of the divided voltage and the variation of the gamma main voltage to be equal to "b", and then the voltage coefficient K is adjusted accordingly to be (a+1)/M, wherein "a" represents a gray scale corresponding to the real-time data voltage, "M" represents a total number of gray scales, "a" is 0 or a positive integer less than "M", "M" is a positive integer;

"b" represents a voltage division coefficient and is equal to K/A, and A is an amplification factor of the operational amplifier circuit.

6. The display device according to claim 5, wherein the voltage division circuit includes a first voltage division resistor and a second voltage division resistor;

a first end of the first voltage division resistor receives the gamma main voltage; a second end of the first voltage division resistor is coupled with the positive input terminal of the operational amplifier circuit;

a first end of the second voltage division resistor is coupled with the positive input terminal; a second end of the second voltage division resistor is coupled with a first voltage terminal;

resistance values of the first voltage division resistor and the second voltage division resistor are adjustable.

7. The display device according to claim 6, wherein the voltage division adjustment signal includes a resistance value adjustment signal;

the adjustment circuit is configured to transmit the resistance value adjustment signal to the first voltage division resistor and/or the second voltage division resistor according to the real-time data voltage and the gamma main voltage, to control adjustment of a resistance value Rz1 of the first voltage division resistor and/or a resistance value Rz2 of the second voltage division resistor, thereby adjusting the voltage coefficient K;

Rz2/(Rz1+Rz2) is equal to "b".

8. A set-voltage generation method applied to the set-voltage generation unit according to claim 7, comprising:

generating, by the voltage generation circuit, a set voltage according to a gamma main voltage so that a ratio between a variation of the set voltage and a variation of the gamma main voltage is a voltage coefficient K, wherein K is a positive number less than or equal to 1.

9. The set-voltage generation method according to claim 8, wherein the set-voltage generation unit further includes an adjustment circuit; the set-voltage generation method includes:

adjusting, by the adjustment circuit, the voltage coefficient K to be (a+1)/B according to a real-time data voltage;

wherein "a" represents a gray scale corresponding to the real-time data voltage, "B" represents a total number of gray scales, "a" is 0 or a positive integer less than "B".

10. The set-voltage generation method according to claim 8, wherein the voltage generation circuit includes an operational amplifier circuit and a voltage division circuit; the step of generating, by the voltage generation circuit, a set voltage according to a gamma main voltage, includes:

dividing, by the voltage division circuit, the gamma main voltage to obtain a divided voltage, and inputting the divided voltage to a positive input terminal of the operational amplifier circuit;

generating, by the operational amplifier circuit, the set voltage according to the divided voltage and a reference voltage input by a reference voltage terminal.

11. A set-voltage generation unit comprising a voltage generation circuit;

wherein an output terminal of the set-voltage generation unit is coupled with a pixel circuit; the set-voltage generation unit is configured to generate a set voltage according to a gamma main voltage such that a ratio between a variation of the set voltage and a variation of the gamma main voltage is a voltage coefficient K, and K is a positive number less than or equal to 1;

wherein the voltage generation circuit includes an operational amplifier circuit and a voltage division circuit;

the voltage division circuit is configured to divide the gamma main voltage to obtain a divided voltage, and input the divided voltage to a positive input terminal of the operational amplifier circuit;

an inverting input terminal of the operational amplifier circuit is coupled with a reference voltage terminal; the operational amplifier circuit is configured to generate the set voltage according to the divided voltage and a reference voltage input by the reference voltage terminal.

12. The set-voltage generation unit according to claim 11, further comprising an adjustment circuit;

wherein the adjustment circuit is configured to adjust the voltage coefficient K to be (a+1)/B according to a real-time data voltage, wherein "a" represents a gray scale corresponding to the real-time data voltage, "B" represents a total number of gray scales, "a" is 0 or a positive integer less than "B", and "B" is a positive integer.

13. The set-voltage generation unit according to claim 11, wherein the set-voltage generation unit further includes an adjustment circuit;

the adjustment circuit is configured to provide a voltage division adjustment signal to the voltage division circuit according to a real-time data voltage, so that the voltage division circuit controls a ratio between a variation of the divided voltage and the variation of the gamma main voltage to be equal to "b", and then the voltage coefficient K is adjusted accordingly to be (a+1)/M, wherein "a" represents a gray scale corresponding to the real-time data voltage, "M" represents a total number of gray scales, "a" is 0 or a positive integer less than "M", "M" is a positive integer;

"b" represents a voltage division coefficient and is equal to K/A, and A is an amplification factor of the operational amplifier circuit.

14. The set-voltage generation unit according to claim 13, wherein the voltage division circuit includes a first voltage division resistor and a second voltage division resistor;

a first end of the first voltage division resistor receives the gamma main voltage; a second end of the first voltage division resistor is coupled with the positive input terminal of the operational amplifier circuit;

a first end of the second voltage division resistor is coupled with the positive input terminal; a second end of the second voltage division resistor is coupled with a first voltage terminal;

resistance values of the first voltage division resistor and the second voltage division resistor are adjustable.

15. The set-voltage generation unit according to claim 14, wherein the voltage division adjustment signal includes a resistance value adjustment signal;

the adjustment circuit is configured to transmit the resistance value adjustment signal to the first voltage division resistor and/or the second voltage division resistor according to the real-time data voltage and the gamma main voltage, to control adjustment of a resistance value Rz1 of the first voltage division resistor and/or a resistance value Rz2 of the second voltage division resistor, thereby adjusting the voltage coefficient K;

Rz2/(Rz1+Rz2) is equal to "b".

16. A display device comprising: M rows and N columns of pixel circuits and N set-voltage generation units;

wherein the set-voltage generation unit includes a voltage generation circuit; the set-voltage generation unit is configured to generate a set voltage according to a gamma main voltage such that a ratio between a variation of the set voltage and a variation of the gamma main voltage is a voltage coefficient K, and K is a positive number less than or equal to 1;

an output terminal of an n-th set-voltage generation unit is coupled with pixel circuits in the n-th column, and is configured to provide the set voltage for the pixel circuits in the n-th column;

wherein both M and N are integers greater than 1, n is a positive integer less than or equal to N;

wherein the display device further comprises: N columns of detection lines, M rows of gate lines, N columns of data lines, M rows of compensation control lines and M rows of write control lines;

wherein the gate line is configured to output a gate drive signal, the data line is configured to output a real-time data voltage, the compensation control line is configured to input a compensation control signal, and the write control line is configured to input a write control signal;

a pixel circuit in an m-th row and an n-th column includes a light emitting element in the m-th row and the n-th column, a drive circuit in the m-th row and the n-th column, a display control circuit in the m-th row and the n-th column, a compensation control circuit in the m-th row and the n-th column, and a set-voltage write control circuit in the m-th row and the n-th column;

a drive circuit in the m-th row and the n-th column is configured to, under control of a control terminal thereof, drive the light emitting element in the m-th row and the n-th column;

a display control circuit in the m-th row and the n-th column is coupled with the control terminal of the drive circuit in the m-th row and the n-th column; and is configured to, under control of a gate drive signal output by a gate line in the m-th row, perform display driving control on the drive circuit in the m-th row and the n-th column according to a real-time data voltage of a data line in the n-th column;

a compensation control circuit in the m-th row and the n-th column is configured to, under control of a compensation control signal input by a compensation control line in the m-th row, control a first terminal of the drive circuit in the m-th row and the n-th column to be coupled with a detection line in the n-th column;

a set-voltage write control circuit in the m-th row and the n-th column is configured to, under control of a write control signal input by a write control line in the m-th row, control a set-voltage write terminal in the m-th row and the n-th column to be coupled with the detection line in the n-th column;

an n-th set-voltage generation unit is configured to write a set voltage in the m-th row and the n-th column to the set-voltage write terminal in the m-th row and the n-th column, to control writing the set voltage in the m-th row and the n-th column to the detection line in the n-th column when the set-voltage write control circuit in the m-th row and the n-th column controls the set-voltage write terminal in the m-th row and the n-th column to be coupled with the detection line in the n-th column;

wherein m is a positive integer less than or equal to M.

17. The display device according to claim 16, wherein the compensation control circuit in the m-th row and the n-th column includes a compensation control transistor in the m-th row and the n-th column; and the set-voltage write control circuit in the m-th row and the n-th column includes a write control switch in the m-th row and the n-th column;

a control electrode of the compensation control transistor in the m-th row and the n-th column is coupled with the compensation control line in the m-th row; a first electrode of the compensation control transistor in the m-th row and the n-th column is coupled with the first terminal of the drive circuit in the m-th row and the n-th column; a second electrode of the compensation control transistor in the m-th row and the n-th column is coupled with the detection line in the n-th column;

a control terminal of the write control switch in the m-th row and the n-th column is coupled with the write control line in the m-th row; a first terminal of the write control switch in the m-th row and the n-th column is coupled with the set-voltage write terminal in the m-th row and the n-th column; a second terminal of the write control switch in the m-th row and the n-th column is coupled with the detection line in the n-th column.

18. The display device according to claim 16, wherein the drive circuit in the m-th row and the n-th column includes a drive transistor in the m-th row and the n-th column; and the display control circuit in the m-th row and the n-th column includes a data write transistor in the m-th row and the n-th column, and a storage capacitor in the m-th row and the n-th column;

a gate electrode of the drive transistor in the m-th row and the n-th column is the control terminal of the drive circuit in the m-th row and the n-th column;

a control electrode of the data write transistor in the m-th row and the n-th column is coupled with the gate line in the m-th row; a first electrode of the data write transistor in the m-th row and the n-th column is coupled with the data line in the n-th column; a second electrode of the data write transistor in the m-th row and the n-th column is coupled with the gate electrode of the drive transistor in the m-th row and the n-th column;

a first electrode of the drive transistor in the m-th row and the n-th column is coupled with the light emitting element in the m-th row and the n-th column; a second electrode of the drive transistor in the m-th row and the n-th column is coupled with the power supply voltage terminal;

a first terminal of the storage capacitor in the m-th row and the n-th column is coupled with the gate electrode of the drive transistor in the m-th row and the n-th column; a second terminal of the storage capacitor in the m-th row and the n-th column is coupled with the first electrode of the drive transistor in the m-th row and the n-th column.

* * * * *